US008955594B2

(12) United States Patent
Bell et al.

(10) Patent No.: US 8,955,594 B2
(45) Date of Patent: Feb. 17, 2015

(54) MULTIPLEX TUBING HANGER

(75) Inventors: Robert Bell, Aberdeen (GB); Rolf Nordaunet, Sandvika (NO); Staale Svindland, Sandvika (NO)

(73) Assignee: Vetco Gray Inc., Houston, TX (US)

( * ) Notice: Subject to any disclaimer, the term of this patent is extended or adjusted under 35 U.S.C. 154(b) by 103 days.

(21) Appl. No.: 13/302,883

(22) Filed: Nov. 22, 2011

(65) Prior Publication Data

US 2013/0126181 A1 May 23, 2013

(51) Int. Cl.

| | |
|---|---|
| ***E21B 7/12*** | (2006.01) |
| ***E21B 41/04*** | (2006.01) |
| ***E21B 23/00*** | (2006.01) |
| ***E21B 33/035*** | (2006.01) |
| ***E21B 33/043*** | (2006.01) |

(52) U.S. Cl.

CPC ..... *E21B 33/035* (2013.01); *E21B 33/043* (2013.01)

USPC ..... 166/348; 166/341; 166/360

(58) Field of Classification Search

USPC ..... 166/338, 339, 341, 348, 360, 368, 166/378–380, 85.1; 285/913; 340/855.1

See application file for complete search history.

(56) References Cited

U.S. PATENT DOCUMENTS

| | | | | |
|---|---|---|---|---|
| 3,838,709 | A | 10/1974 | Castela | |
| 5,503,230 | A * | 4/1996 | Osborne et al. | 166/344 |
| 6,666,274 | B2 * | 12/2003 | Hughes | 166/385 |
| 7,032,673 | B2 | 4/2006 | Dezen et al. | |
| 7,159,616 | B2 | 1/2007 | Watson et al. | |
| 7,607,485 | B2 | 10/2009 | Fenton et al. | |
| 7,770,650 | B2 | 8/2010 | Young et al. | |
| 8,011,436 | B2 | 9/2011 | Christie et al. | |
| 2004/0140125 | A1 * | 7/2004 | Dezen et al. | 175/7 |
| 2008/0245529 | A1 * | 10/2008 | Christie et al. | 166/368 |
| 2010/0006301 | A1 * | 1/2010 | Fenton | 166/368 |
| 2010/0078176 | A1 * | 4/2010 | Christie | 166/368 |

FOREIGN PATENT DOCUMENTS

| | | | |
|---|---|---|---|
| EP | 0611874 | A1 | 8/1994 |
| GB | 1265355 | A | 3/1972 |
| GB | 2262298 | A | 6/1993 |

OTHER PUBLICATIONS

Search Report from corresponding GB Application No. GB1220756.9 dated Jan. 31, 2013.

* cited by examiner

*Primary Examiner* — Matthew Buck
*Assistant Examiner* — Stacy Warren
(74) *Attorney, Agent, or Firm* — Bracewell & Giuliani LLP

(57) ABSTRACT

A subsea wellhead assembly having a tubing hanger set in a tubing hanger spool and a ring with axial passages set in an upper end of the tubing hanger. The wellhead assembly includes a production tree that lands on the tubing hanger spool. Tubing extends from the axial passages in the ring through axial bores provided in a sidewall of the tubing hanger. When landed, a lower end of the production tree engages an upper surface of the ring causing the ring to rotate and align its axial passages with axial passages in the production tree. The respective lower and upper surfaces of the tree and ring are strategically castellated to orient the passages.

7 Claims, 6 Drawing Sheets

MULTIPLEX TUBING HANGER

BACKGROUND

1. Field of Invention

The invention relates generally to a subsea wellhead assembly and a method of forming a subsea wellhead assembly. More specifically, the present invention relates generally to a method of forming a subsea wellhead, and a subsea wellhead, that provides fluid communication through an annular member landed within a housing or spool.

2. Description of Prior Art

Subsea wellbores are formed from the seafloor into subterranean formations lying underneath. Systems for producing oil and gas from subsea wellbores typically include a subsea wellhead assembly set over an opening to the wellbore. Subsea wellheads usually include a high pressure wellhead housing supported in a lower pressure wellhead housing and secured to conductor casing that extends downward past the wellbore opening. Wells are generally lined with one or more casing strings coaxially inserted through, and significantly deeper than, the conductor casing. The casing strings are typically suspended from casing hangers landed in the wellhead housing. One or more tubing strings are usually provided within the innermost casing string; that among other things are used for conveying well fluid produced from the underlying formations. The produced well fluid is typically controlled by a production tree mounted on the upper end of the wellhead housing. The production tree is typically a large, heavy assembly, having a number of valves and controls mounted thereon. One of the largest challenges when running and installing tubing hangers in wellheads are ensuring correct orientation to prevent damaging the couplers and seals between the production tree and tubing hanger during installation of the production tree. Several systems have been previously employed to achieve orientation, which consume valuable rig resources.

Some subsea wellhead assemblies include a tubing hanger spool that lands on an upper end of the high pressure housing. The tubing hanger is supported within the tubing hanger spool, and can be landed therein prior to or after the production tree mounts to the upper end of the tubing hanger spool. Difficulties are typically encountered when landing the tubing hanger in the tubing spool and ensuring the tubing hanger is properly oriented so that axial passages in the tubing hanger and production are aligned.

SUMMARY OF THE INVENTION

Disclosed herein is an example of a subsea wellhead assembly. In an example embodiment the subsea wellhead assembly includes a wellhead housing with a spool on its upper end. An annular member is set within the tubing hanger spool and a ring, that can rotate, is disposed on the annular member. The ring has a contoured upper surface. A production tree is included on an upper end of the spool; the lower end of the production tree is engaged with an upper surface of the ring. The lower end of the ring also has a contour, where the contour corresponds to the contoured upper surface of the ring, thus when the production tree is lowered onto the ring, the ring rotates into a designated azimuth. Optionally, a passage may be included that extends vertically through the ring, and where flexible tubing is in the passage that extends into a vertical bore in the annular member. In one example embodiment, the contoured upper surface is a series of pockets along the circumference of the ring, and wherein an upper end of the passage terminates in a pocket. Alternatively, the contoured upper surface of the ring and contour of the lower end of the production tree each are a series of pockets with angled lateral sides that form an interference when the production tree is positioned at an azimuth offset from the designated azimuth. Vertical bores may optionally be included in the annular member along with axial passages in the ring and flexible tubing that extends between the vertical bores and axial passages in the ring and axial passages in the production tree. In this example, when the production tree is landed while positioned at an azimuth offset from the designated azimuth, the axial passages in the ring azimuthally move with respect to the vertical bores and the flexible tubing bends in response to the movement of the axial passages in the ring. In an example, the vertical bores and axial passages in the production tree come into communication when the production tree lands onto the spool and remain in communication when the ring is rotated. A channel may be optionally included that extends circumferentially along the upper surface of the annular member so that the ring rotates in the channel. In one alternate example, the azimuth of the production tree remains substantially the same while being landed. The annular member can be a tubing hanger and the spool can be a tubing hanger spool.

Also disclosed herein is a method of forming a wellhead assembly subsea, that in an example includes providing a ring that has an axial passage, where the ring is mountable onto an annular member having a vertical bore. Flexible tubing extends between the axial passage and the vertical bore. The method also includes providing an upper member with a vertical passage and a lower surface that mates with a profile on an upper surface of the ring, and positioning the ring and upper member into a designated orientation. The upper member is lowered onto the ring when the ring is mounted on the annular member and the vertical passage in the upper member communicates with the vertical bore by engaging the respective profiles on the upper member and the ring to azimuthally rotate the ring into the designated orientation that aligns the vertical passages in the ring and the upper member. The upper member can be a production tree and optionally, the annular member comprises a tubing hanger. The method can further include landing the annular member in a wellhead housing. In an example, the annular member is a tubing hanger and the wellhead housing is a tubing hanger spool. The method can also further include orienting the upper member before being landed onto the ring at angular range of around 20° from a designated azimuth. Further optionally, fluid can be directed through the axial passages of the upper member and ring, the flexible tubing, and the vertical bore.

BRIEF DESCRIPTION OF DRAWINGS

Some of the features and benefits of the present invention having been stated, others will become apparent as the description proceeds when taken in conjunction with the accompanying drawings, in which.

Figure 1:
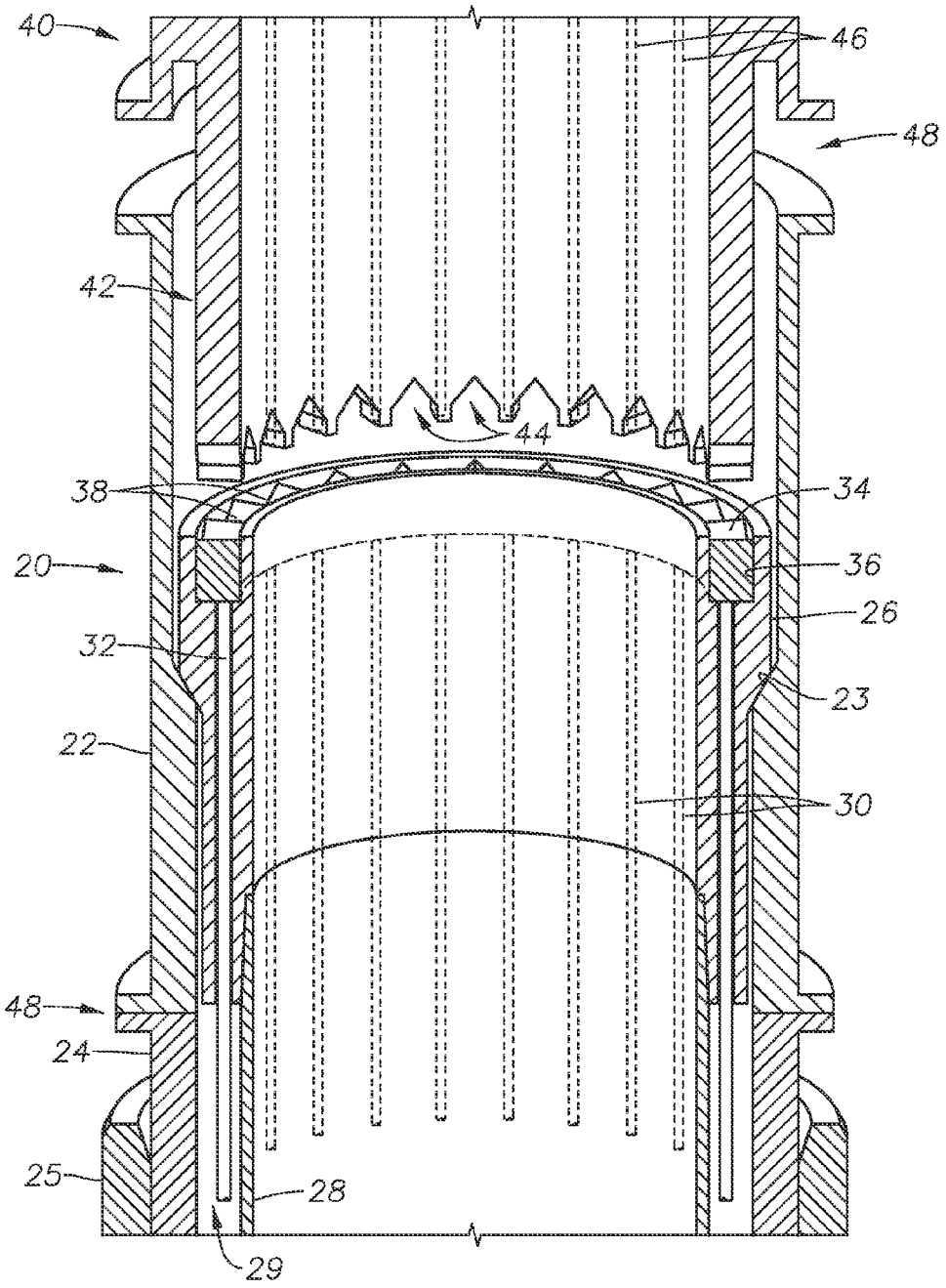
FIG. 1 is a side sectional perspective view of an example embodiment of a wellhead assembly in accordance with the present invention.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation. Accordingly, the improvements herein described are therefore to be limited only by the scope of the appended claims.

Shown in FIG. 1 is a side sectional perspective view of an example embodiment of a wellhead assembly 20 that includes a tubing hanger spool 22 mounted on a wellhead housing 24. The tubing hanger spool 22 of FIG. 1 is a generally annular member having an inner radius that transitions inward to define a ledge 23; the wall thickness of the hanger spool 22 increases below the ledge 23. In the example of FIG. 1, the wellhead housing 24 is a high pressure wellhead housing and is shown partially circumscribed by an outer lower pressure wellhead housing 25. Landed within the ledge 23 of the tubing spool 22 is a tubing hanger 26 on which a length of tubing 28 is shown extending downward into a wellbore (not shown) over which the wellhead assembly 20 is disposed. Tubing 28 defines an annulus 29 between it and the inner radius of the wellhead housing 24.

A series of vertical bores 30 are shown in dashed outline extending through a side wall of the tubing hanger 26. Illustrated disposed within one of the passages 30 is flexible tubing 32 having a lower end projecting into the annulus 29 and an upper end coupled within an annular ring 34. The ring 34 of FIG. 1 is shown set flush within the upper end of the tubing hanger 26 and in a groove 36 that is formed along the entire circumference of the upper end of the tubing hanger 26. Further illustrated in the embodiment of FIG. 1 are a series of pockets 38 formed in an upper surface of the ring 34. The lower end of the pockets 38 of FIG. 1 are intersected by the upper terminal ends of the passages 30.

Further depicted in the embodiment of FIG. 1 is a production tree 40 being landed onto an upper end of the tubing hanger spool 22; wherein a lower portion of a tree body 42 coaxially extends within the upper open end of the tubing spool 22. A series of pockets 44 are shown in the lower terminal end of the tree body 42, and like the pockets 38 on the upper surface of the ring 34, the pockets 44 extend substantially along the circumference of the lower end of the tree body 42. It should be pointed out, however, that embodiments exist wherein pockets 38, 44 are selectively provided in strategic locations along the ring 34 and tree body 42. Further, each of the ring 34 and tree body 42 may have substantially fewer pockets 38, 44 than those illustrated in FIG. 1. Example embodiments exist where each of the ring 34 and tree body 42 include a single pocket 38, 44. Vertical passages 46 are shown formed axially through the tree body 42 and terminate in a space between adjacent pockets 44. Optionally, flanges 48 may be provided on the tree body, tubing hanger spool 22, and wellhead housing 24 for attachment to one another. Optionally, threaded fittings or wells may be used for attaching these members.

Figure 2:
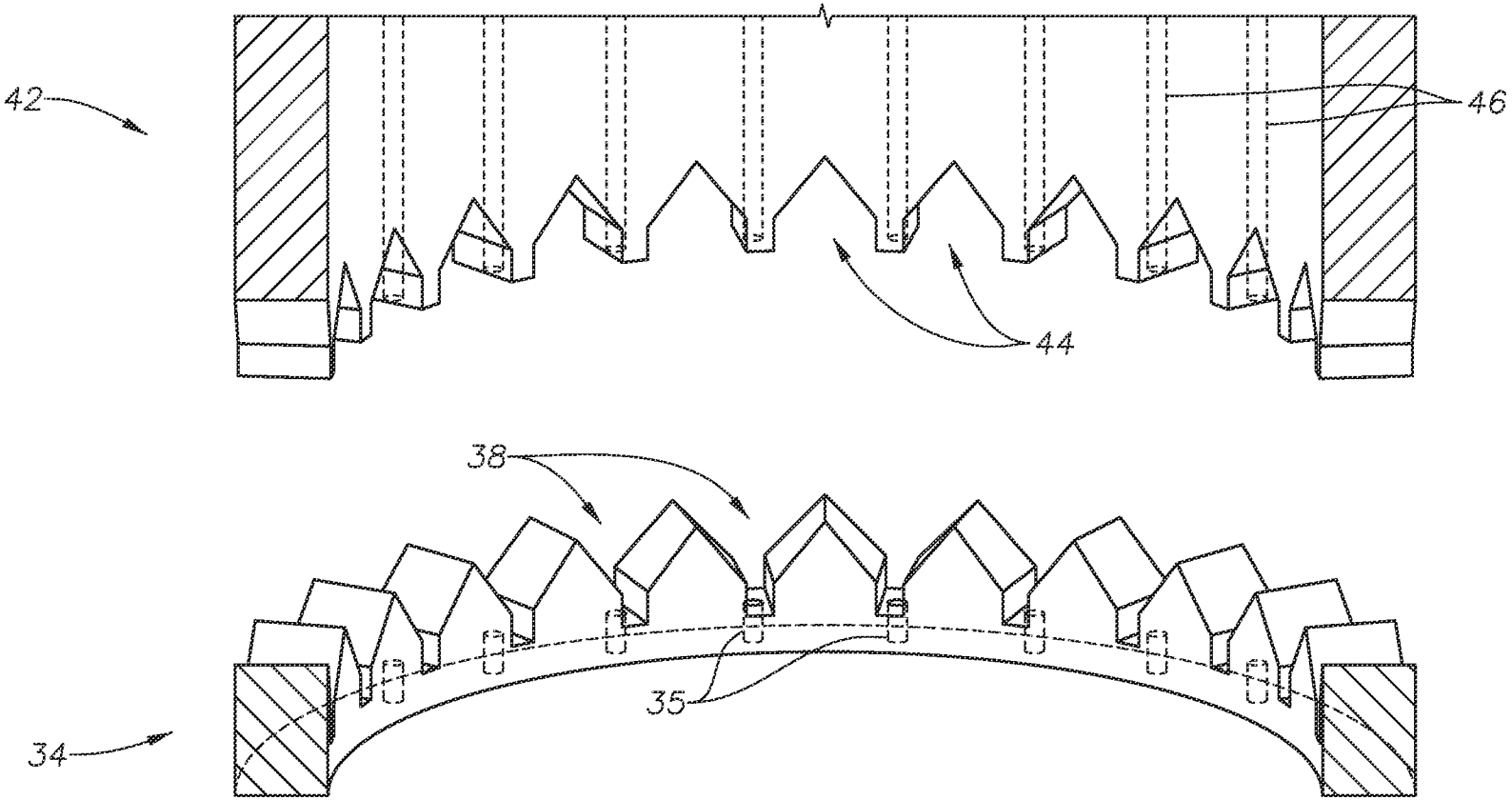
FIG. 2 is a detailed view of the example embodiment of FIG. 1.
Figure 3A:
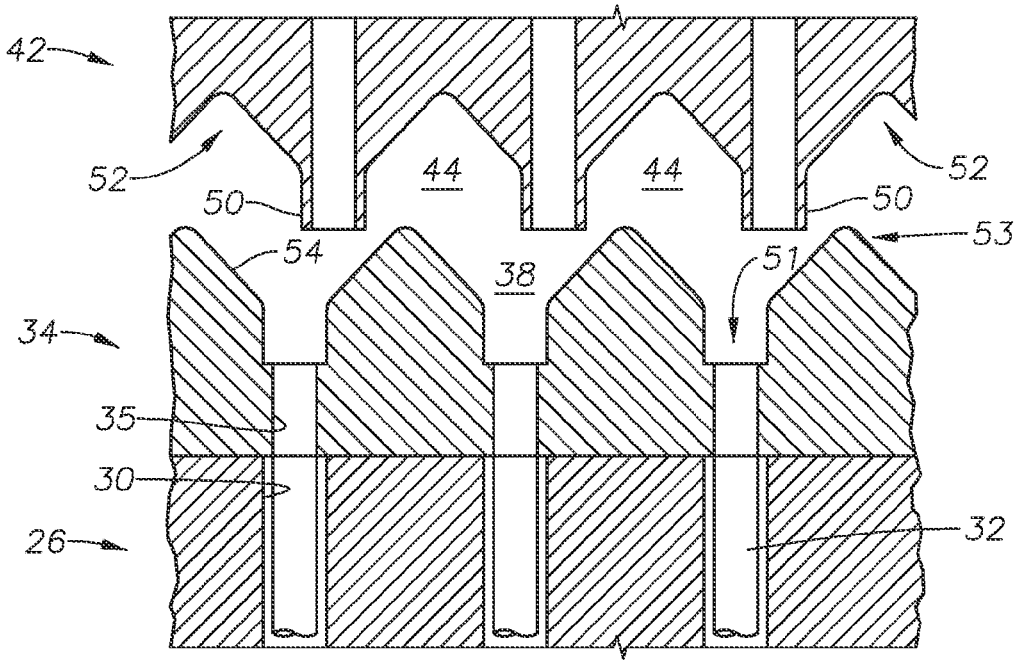
FIGS. 3A and 3B are side views of a lower end of a production tree landing within a tubing hanger spool in accordance with the present invention.

Referring now to FIG. 2, a detailed perspective view is shown of the tree body 42 being landed onto the ring 34. The respective pockets 38, 44 are oriented offset from one another so that when landed, the ring 34 will need to rotate about its axis so that the pockets 38, 44 align and can mesh, where rotation can occur from a torque tool on a remotely operated vehicle (not shown), a diver, or hydraulic action from a control pod (not shown). The pockets 38, 44 can mesh when the production tree 40 is being landed, an example of which is illustrated side view in FIGS. 3A and 3B. In this example the tree body 42 is angularly offset from a designated azimuth and will need to rotate, or be rotated, into a designated azimuth. Specifically referring now to FIG. 3A, the shape and location of the pockets 44 provided on the lower end of the tree body 42 define protrusions 50 that project downward and towards the ring 34. The protrusions 50 are strategically formed to set within the lowermost portion 51 of the pockets 38 on the upper surface of the ring 34 when the tree body 42 is landed on the ring 34 and/or the tubing hanger 26. Similarly, the position and shape of the pockets 38 on the upper surface of the ring 34 define a series of peaks 53 that can extend up into an upper portion 52 of the pockets 44 on the lower surface of the tree body 42. Moreover, the peaks have angled lateral sides 54 on which the lower end of the protrusions 50 can land when pockets 38, 44 are offset from one another. The respective mass of the tree body 42 as compared to the mass of the ring 34 will rotate the ring 34 rather than rotating the tree 42 as the protrusion 50 slides down the lateral side 54.

Figure 3B:
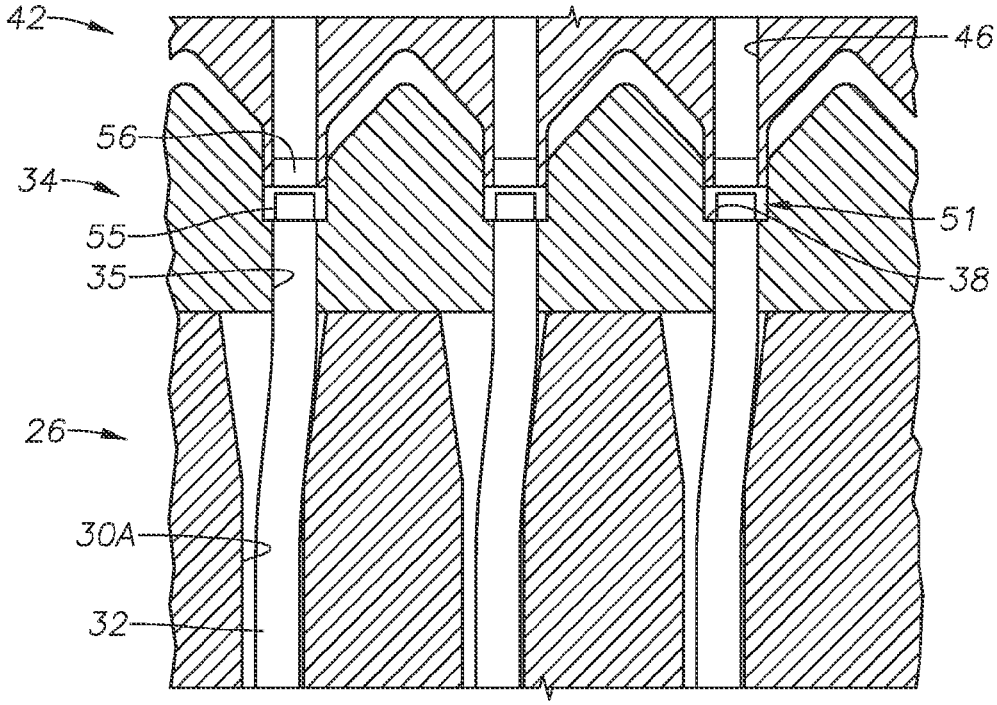

FIG. 3B illustrates a side view of the tree body 42 lowered onto the ring 34 and the protrusions 50 being set into the lowermost portion 51 of the pocket 38. As discussed above, when the tree body 42 engages the ring 34 at a time when the ring 34 and tree body 42 are angularly offset from one another, the ring 34 is rotated about its axis in response to the strategic forming of the respective profiles created by the pockets 38, 44. As the flexible tubing 32 is coupled to the ring 34 and extends through the passages 30 within the tubing hanger 26, the tubing 32 will bend or otherwise deform with rotation of the ring 34. The bending of the tubing 32 is illustrated in FIG. 3B where the tubing 34 is set at an angle reflective of the rotation of the ring 34 as the tree body 42 is landed thereon. In one example, a desired indexing or communication between passages 35, 46 can be confirmed by flowing fluid through a dummy flow loop of two or more lines, through the hanger 26, and back to a control pod (not shown). Monitoring the fluid flowing back to the control pod can confirm that the indexing of the passages 35, 46 is correct.

In one alternate embodiment, the passages 30A have an upper end that flares radially outward to accommodate the bending and reduce stresses within the tubing 32. Also optionally provided are a male coupler 55 in the lower end of the pocket 38 that engages a female coupler 56 (shown in dashed outline) that is set within passage 46 and in the protrusion 50. The couplers 55, 56 may be coaxially inserted within one another to provide communication from the passage 46 to the passage 35 and into the tubing 32. As such, by strategically forming the pockets 38, 44 the tree body 42 may be in an orientation with respect to the tubing hanger 26 to facilitate fluid communication through both the tubing hanger 26 and tree body 42. Moreover, the designated orientation may be achieved without the need for orientation devices that take up or consume the limited radial space within the wellhead assembly.

Figure 4:
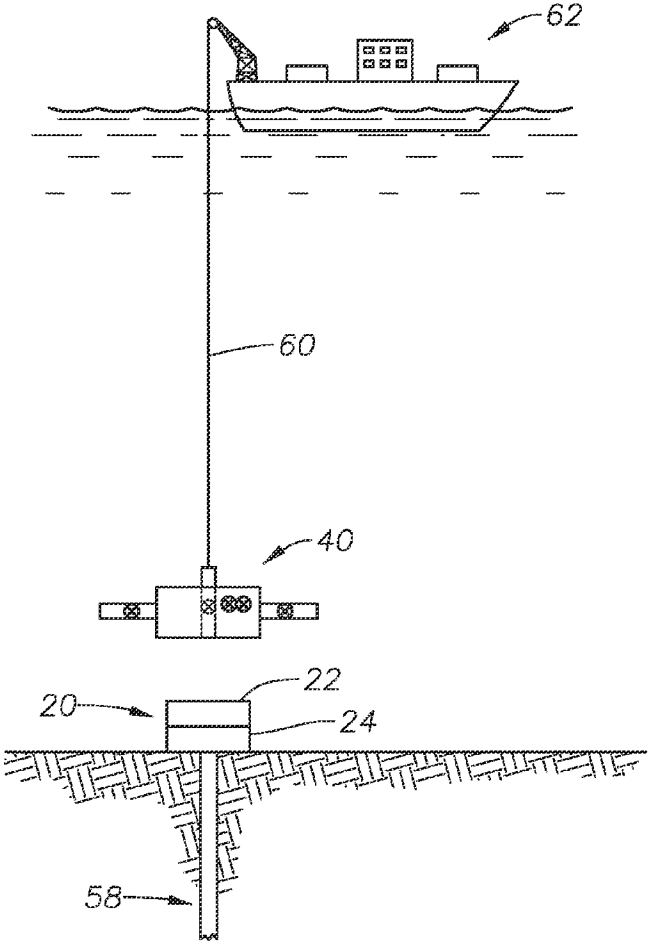
FIG. 4 is a side view of a production tree being lowered subsea from a work vessel in accordance with the present invention.

In FIG. 4, an example of forming a subsea wellhead assembly 20 is shown in a side view wherein the production tree 40 is illustrated being landed onto the wellhead housing 24. The wellhead housing 24 is shown set over the wellbore 58. A wireline 60 is coupled on an upper end of the production tree 40 and a surface vessel 62 is used for controlling lowering of the production tree 40. A remotely operated vehicle (not shown) may be used to pre-orient the production tree 40 as it is lowered and landed onto the wellhead housing 24.

Figure 5:
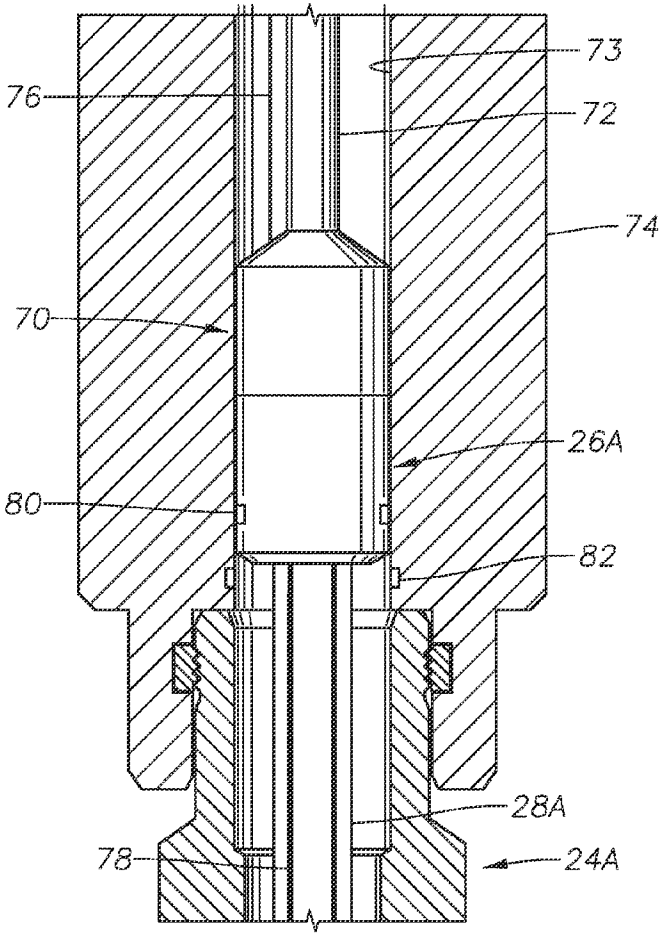
FIG. 5 is a side sectional view of an example embodiment of a tubing hanger being landed in a wellhead assembly in accordance with the present invention.

Referring now to FIG. 5, a side partial sectional view is shown of an alternate embodiment of a tubing hanger 26A being landed in a wellhead housing 24A. In this example the tubing hanger 26A is shown attached to a running tool 70 that is mounted on a lower end of a drill string 72. The tubing hanger 26A is being inserted through a bore 73 axially formed through a blow out preventer (BOP) 74 shown mounted on an upper end of the wellhead housing 24A. An umbilical 76 is also illustrated that in the example of FIG. 5 includes lines 78, such as electrical and hydraulic, that extend into the wellbore and project through the tubing hanger 26A. In the example of FIG. 5, sensors 80 are provided with the tubing hanger 26A that communicate with sensors 82 in the BOP 74. The sensors 80, 82 are strategically located on the tubing hanger 26A and BOP 74 and generate a response that is dependent on the relative position of a communicating sensor. By monitoring a signal or signals from one or more of the sensors 80, 82 as the tubing hanger 26A is being landed, the orientation of the tubing hanger 26A can be monitored and adjusted to a desired azimuth.

Figure 6:
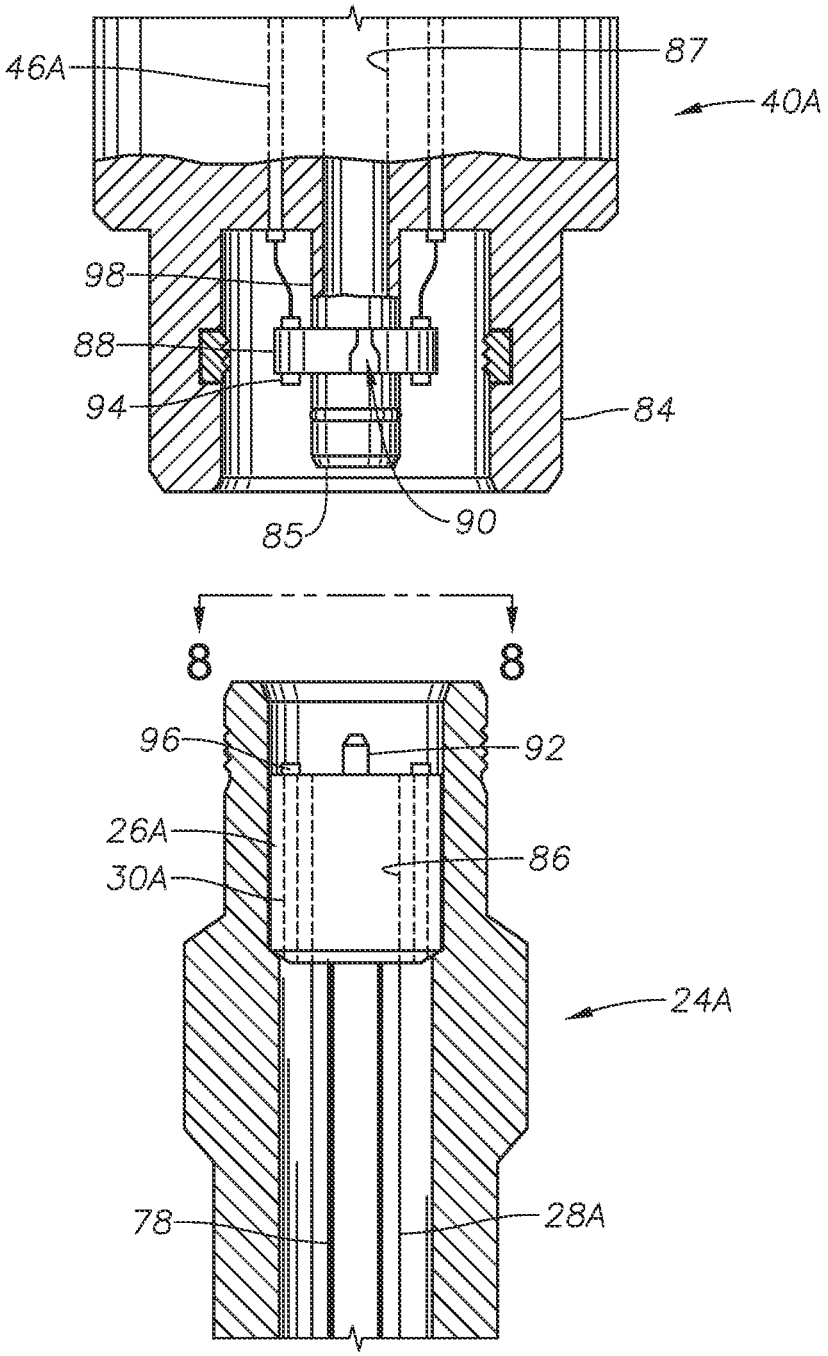
FIGS. 6 and 7 are side partial sectional views of a production tree landing on a wellhead assembly in accordance with the present invention.

FIG. 6 illustrates a side partial sectional view of the tubing hanger 26A landed in the wellhead housing 24A and a production tree 40A landing on the housing 24A above the tubing hanger 26A. An annular connector 84 depends axially downward from a lower end of the production tree 40A. A tubular production stab 85 also depends axially downward from the lower end of the production tree 40A and coaxial within the connector 84. The production stab 85 provides fluid communication between bores 86, 87 provided respectively through the production tree 40A and tubing hanger 26A. A disk 88 is shown circumscribing the production stab 85, where the disk 88 rotatable about the stab 85. An alignment slot 90 is shown formed in a portion of an outer periphery of the disk 88 that extends generally axially along the width of the disk 88. The upper portion of the slot 90 has a width that is approximately equal to the width of an alignment pin 92 shown projecting axially upward from the tubing hanger 26A. The width of the slot 90 flares outward so that its lower portion (or opening) is larger than the upper end of the alignment pin 92. Couplers 94 are shown on a lower surface of the disk 88, that as will be described in more detail below, engage couplers 96 provided on an upper surface of the tubing hanger 26A when the production tree 40A lands onto the wellhead housing 24A. Couplers 94, 96 respectively communicate with passages 46A, 30A in the production tree 40A and tubing hanger 26A. Tubing 98 extends from an upper surface of the disk 88 to the production tree 40A to provide communication between couplers 94 and passages 46A.

Figure 7:
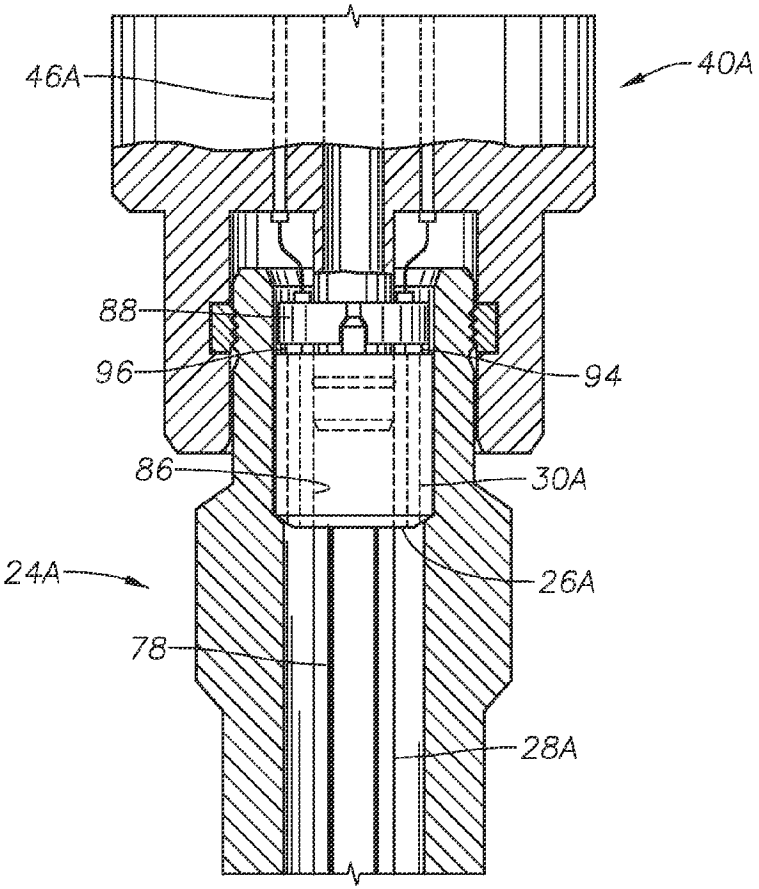

As shown in the side partial sectional view in FIG. 7, the production tree 40A is lowered onto the wellhead housing 24A and the lower end of the production stab 85 inserts into the bore 86 in the tubing hanger 26A. The alignment slot and pin 90, 92 are strategically located so that when the pin 92 inserts into the slot 90, couplers 94 are aligned with couplers 96 and can engage one another when the disk 84 is lowered. In the example of FIG. 7, couplers 94 insert within couplers 96, alternate embodiments exist wherein couplers 96 inter into couplers 94. Referring back to the example of FIG. 6, the pin 92 is offset at an angle with the slot 90. As noted above the opening to the slot 90 is enlarged, which allows some tolerance for misalignment when landing the disk 84. In one example, the tolerance can range up to around +/−7° of angular offset between the pin 92 and slot 90. Guide posts or a guide line less system (not shown) can be used for orienting the production tree 40A during landing. When there is offset between the slot 90 and pin 92, the disk 88 is rotated by the pin 92 entering the lower width portion of the slot 90. The tubing 98, which in one example is formed from an elastic material, has deformed from its configuration of FIG. 6 with rotation of the disk 88.

Figure 8:
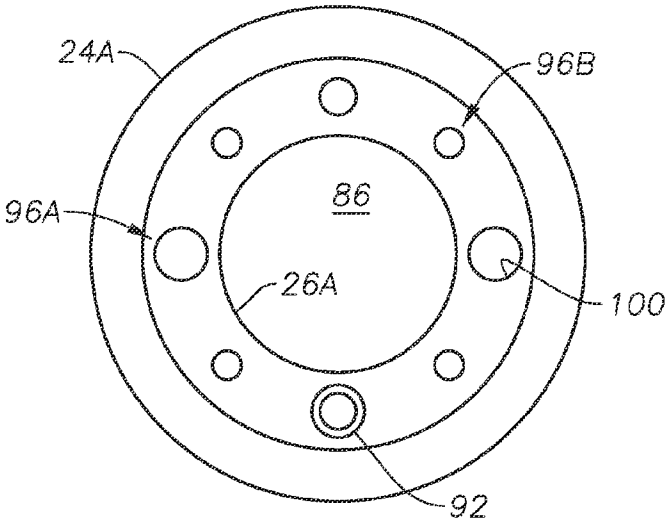
FIG. 8 is an overhead view of the wellhead assembly of FIG. 6 in accordance with the present invention.

FIG. 8 is an overhead view of the wellhead housing 24A and landed tubing hanger 26A taken along lines 8-8 of FIG. 6. In this example, both electric/optical couplers 96A and hydraulic couplers 96B are shown on the tubing hanger 26A. Similarly, embodiments exist wherein some of the couplers 94 on the production tree 40A (FIG. 7) are electric/optical and some are hydraulic. An overhead view of the alignment pin 92 is shown, which in the embodiment of FIG. 8 has a generally circular outer configuration. An annulus vent 100 is further depicted on the upper end of the tubing hanger 26A, that in one example may be formed to receive a coupler 94 (FIG. 7) therein.

Optionally, the production tree 40 can be landed at any azimuth which is an advantage of implementing the present disclosure. In this example, the castellated protrusions 50 and pockets 38 obtain an unknown index position. Using the multiplexing methods described above, desired passages 35, 46 can be aligned and communication through the wellhead assembly 40 of a specific line can be confirmed. In an example, the production tree 40 is landed within +/−15° of the designated aligned azimuth, which can be visually confirmed/performed. This rough alignment, in conjunction with the castellated protrusions 50 and pockets 38, positions the tree 40 within a tolerance band of the castellation pick up zone. This removes the need for orienting the hanger 26 while it is being landed, thus eliminating the need for complex tooling that is susceptible to tolerance problems. Superimposing the hardware that orients the hanger 26 saves space within the tree body 42.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A method of forming a subsea wellhead assembly comprising:

a. providing a ring, said ring being mountable onto a hanger having a sidewall with a vertical bore and having an axial passage that is located through a sidewall of the ring and spaced radially outward from a main bore in the ring, and providing flexible tubing extendable between the axial passage and the vertical bore;

b. providing a production tree with a vertical passage and a lower surface having an undulating profile configured to mate with an undulating profile that circumscribes an upper surface of the ring;

c. lowering the production tree onto the ring when the ring is mounted on the hanger; and d. communicating the vertical passage in the production tree with the vertical bore by engaging the respective profiles on the production tree and the ring to azimuthally rotate the ring into a designated azimuthal orientation that aligns the axial passages in the ring with the vertical passage in the production tree.

2. The method of claim 1, wherein when the ring is offset from the designated azimuthal orientation when the production tree is lowered onto the ring, interference between the respective profiles on the production tree and the ring rotates the ring into the designated azimuthal orientation.

3. The method of claim 2, wherein when the ring is rotated into the designated azimuthal orientation, flexible tubing that extends through the vertical passages bends to accommodate rotation of the ring.

4. The method of claim 1, wherein the hanger is a tubing hanger that has a string of tubing depending into a wellbore below the wellhead assembly.

5. The method of claim 4, further comprising producing wellbore fluid through the tubing hanger.

6. The method of claim 1, further comprising orienting the production tree before being landed onto the ring at an angular range of around 20° from the designated azimuthal orientation.

7. The method of claim 1, further comprising flowing fluid through the passages of the production tree and ring, the flexible tubing, and the vertical bore.

* * * * *